United States Patent [19]

Thompson, Jr.

[11] 4,037,916

[45] July 26, 1977

[54] HIGH CURRENT DENSITY ELECTRICAL CONTACT

[76] Inventor: Lloyd E. Thompson, Jr., 158 Clark Road, Rye, N.H. 03870

[21] Appl. No.: 676,446

[22] Filed: Apr. 12, 1976

[51] Int. Cl.[2] ..... H01R 13/12

[52] U.S. Cl. ..... 339/258 R; 339/262 R

[58] Field of Search ..... 339/183, 258, 259, 262

[56] References Cited

U.S. PATENT DOCUMENTS

| | | | |
|---|---|---|---|
| 2,486,285 | 10/1949 | Hurst | 339/258 A |
| 3,278,885 | 10/1966 | Klinger | 339/258 A |

FOREIGN PATENT DOCUMENTS

| | | | |
|---|---|---|---|
| 1,009,830 | 3/1952 | France | 339/258 RR |
| 601,294 | 5/1948 | United Kingdom | 339/262 R |

*Primary Examiner*—Joseph H. McGlynn
*Attorney, Agent, or Firm*—R. S. Sciascia; L. I. Shrago; C. E. Vautrain, Jr.

[57] ABSTRACT

The disclosure concerns an electrical contact for conducting high current densities in a minimum space at acceptable operating temperatures and lower contact resistance than conventional slotted contacts of equivalent size. The contact pin is formed in a series of cascaded extensions and the contact receptacle contains respective sections each threaded or otherwise joined within the other. The external receptacle section and the cascaded pin are made of oxygen-free copper for maximum conductivity.

12 Claims, 9 Drawing Figures

HIGH CURRENT DENSITY ELECTRICAL CONTACT

The present invention concerns electrical contacts and, more particularly, a contact for providing high current density conduction in a minimum space at acceptable operating temperatures and reduced contact resistance.

Conventional slotted contact receptacles, i.e. those concentrically mated with a pin contact, are used in particular applications to provide a single circular line contact area. In order to maintain a proper relationship between contact pressure, insertion forces, and cross sectional tine area, conventional high amperage slotted contacts are normally several inches in length. During mating of the pin and contact receptable, considerably insertion forces are encountered for this entire length. To insure proper assembly, clearances must be machined in the parts with result, however, that contact is made only at the entrance of the socket. Such contact is essentially along a circle of very narrow band of the mating parts and, as may be appreciated, results in very high temperatures and considerably contact resistance in the small area of contact as well as a failure to utilize the majority of the pin surface for transfer of current.

The problem of producing high conductivity in a minimum space is especially critical in instances where conduction is desired through a surface or an area where very limited openings can be tolerated. One example of such a surface is the pressure hull of a submarine. The present invention overcomes the deficiencies of prior art contacts by providing maximum conduction through utilizing all or substantially all of the mating surfaces of the pin and receptable while requiring a minimum cross-sectional area through which the pin and receptable extend.

Accordingly, it is an object of the present invention to provide an electrical contact which is capable of conducting high current densities while occupying a minimum of space.

Another object of the invention is to provide an electrical contact for conducting current on the order of 1,000 amperes or more through a minimum space.

A further object of the invention is to provide an electrical contact which distributes current over a substantial area and yet is easy to assemble and requires an insertion force only at the final length of connector pin travel.

A further object of the invention is to provide improved connector reliability through a plurality of individual contact tines as opposed to the single set of contact tines in conventional slotted contacts.

Other objects, advantages and novel features of the invention will become apparent from the following detailed description thereof when considered in conjunction with the accompanying drawings in which like numerals represent like parts throughout and wherein.

The present invention concerns, in general, an electrical contact preferably having a plurality of cascaded segments and a series of mating receptacle sections each threaded or otherwise joined within the other. The interior receptacle sections of a preferred embodiment have threaded bases and terminate in flat surfaces so that all such sections abut against a planar surface of the external receptacle section. After assembly, the receptacle sections are drilled and pinned in order to maintain good electrical contact between each section base and the planar surface of the external receptacle section. The pin and receptacles are connected to respective conductors by conventional means and can be utilized in conventional electrical fitting envelopes. The contacting portions of the receptable sections preferably are made in the form of tines which have a greater length than the length of each respective cascaded pin segment which is to be inserted therein. The pin is inserted a substantial portion of its length into the receptacle before contact is made simultaneously between each cascaded pin segment and the tines of the respective receptacle section.

Figure 1:
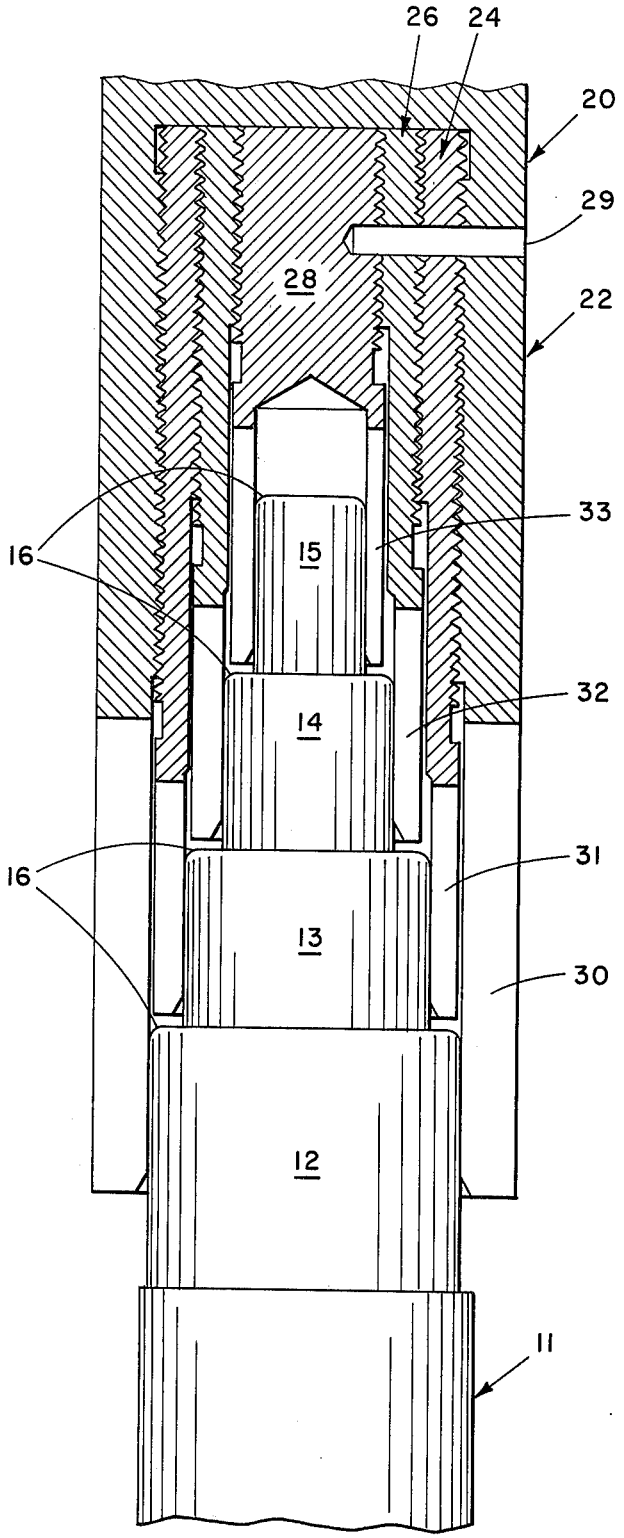
FIG. 1 is a front elevation partly in section of the assembled pin and receptacle of one embodiment of the present invention.

Referring to the drawings, FIG. 1 shows the preferred form of the invention and includes a cascaded pin 11 having a plurality of segments or steps 12, 13, 14 and 15 which are shown inserted in operating condition into a receptacle 20. Pin 11 preferably is silver plated to reduce contact resistance and each step thereof is provided with a slight radius 16 to facilitate engagement with the respective receptacle section and to avoid damage to the contacting surfaces. Receptacle 20 in the preferred embodiment is formed of an external section 22, intermediate sections 24 and 26, and an internal section 28. All contacting, threaded, and abutting surfaces of the receptacle sections are also silver plated to reduce contact resistance. The sections are drilled and pinned as indicated at 29. External section 22 and cascaded pin 11 are connected to conventional conductors in a manner such as that shown generally in FIGS. 8 and 9. The receptacle sections each include contacting portions 30-33, respectively, which portions preferably are in the form of tines and vary in number depending upon the diameter of the respective sections.

Figure 6:
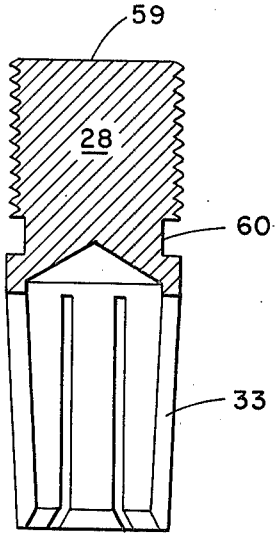
FIG. 6 is a front elevation partly in section of the interior receptacle section which is threaded into the section of FIG. 5.
Figure 7:
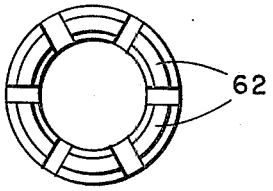
FIG. 7 is an end view of the tine end of the receptacle of FIG. 6.
Figure 2:
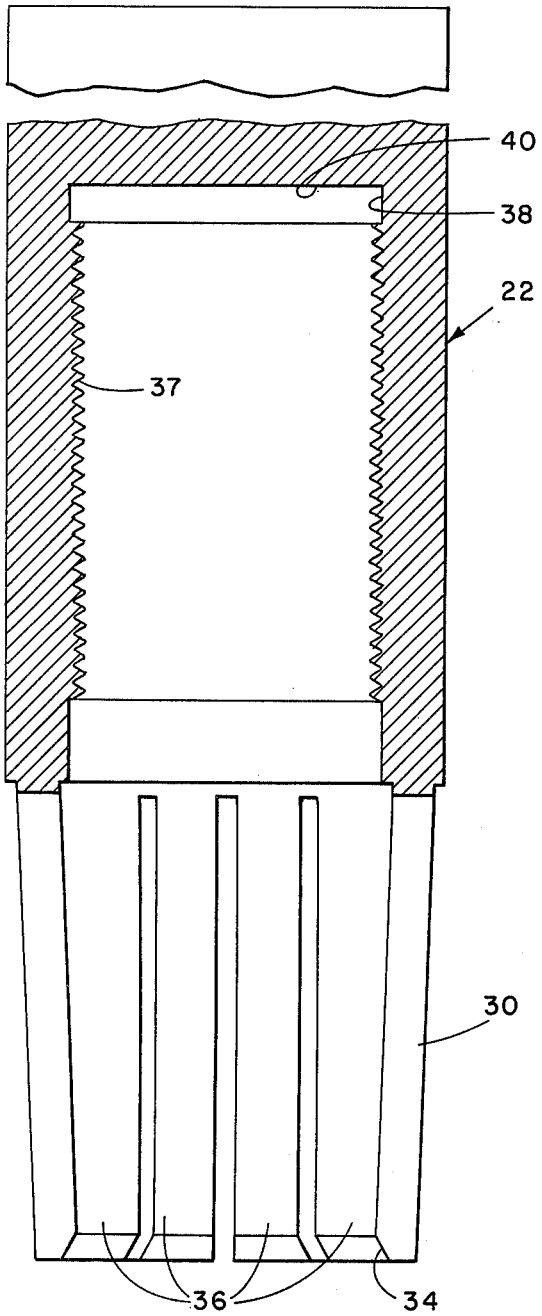
FIG. 2 is a front elevation partly in section of the external receptacle section of the embodiment of FIG. 1.
Figure 3:
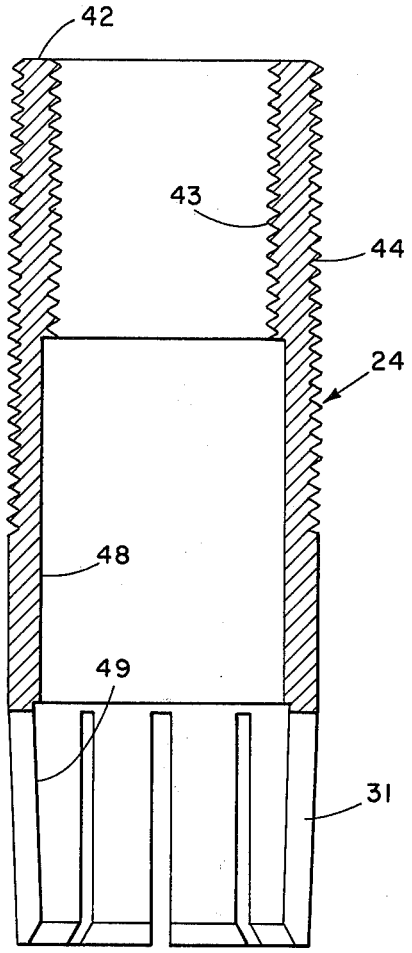
FIG. 3 is a front elevation partly in section of the receptacle section which is threaded into the section of FIG. 2.
Figure 4:
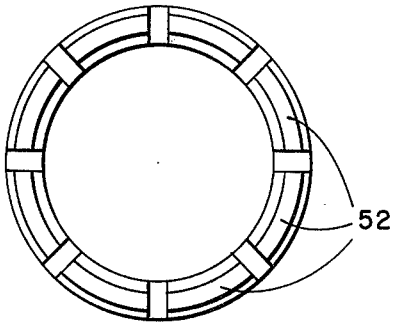
FIG. 4 is an end view of receptacle section of FIG. 3 illustrating the tines which are formed in one end of the section.
Figure 5:
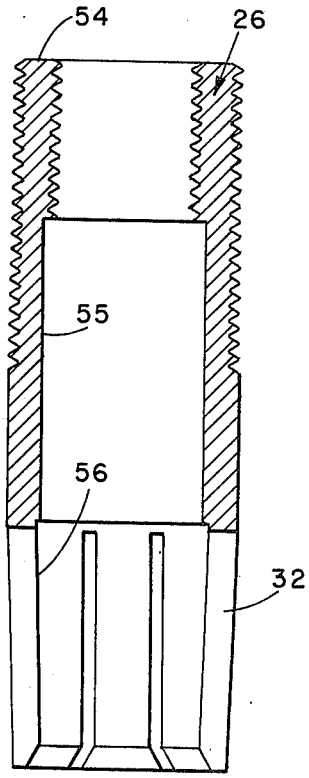
FIG. 5 is a front elevation partly in section of the receptacle section threaded into the section of FIG. 3.

FIGS. 2-7 show in detail the construction of the various receptacle sections, with FIG. 2 illustrating external section 22 and more clearly depicting a plurality of tines 36 which provide contact with segment 12 of pin 11 when the units are assembled. The tine ends are normally chamfered as indicated at 34, again to facilitate mating with step 12 of pin 11. Section 22 preferably is of unitary construction, is threaded internally as indicated at 37, and is provided with a threadundercut indicated at 38 to receive section 24. A planar surface 40 is formed at the internal end of the receptacle opening for receiving in abutting relationship the end surfaces of the remaining receptacle sections. Section 22 preferably is made of oxygen-free copper and the tine ends may be spring loaded as desired to provide increases contact pressure with pin segment 12. In FIG. 3, receptacle section 24 is shown as having a planar end surface 42 and interior and exterior threads 43 and 44, respectively. Section 24 also is shown with the internal threads removed as indicated at 48 to provide clearance for contacts 32 of receptacle section 26 to expand when mated with step 14 of contact pin 11. Section 24 is further cut away as indicated at 49 to provide the desired resiliency and contact pressure in receiving segment 13. The receptacle section preferably has all surfaces silver plated to provide more efficient transfer of current. A plurality of tines 52 of section 24 are shown in FIG. 4 and are eight in number for this size diameter. FIG. 5 shows in detail section 26 which is provided with features similar to those shown in relation to section 24 such as a planar surface 54, an internal recess 55 and a cut away area 56. FIG. 6 shows in detail the construction of internal section 28 which is the central receptacle section and has a solid base and a planar end surface 59. Section 28 also has a thread-undercut as indicated at 60 which undercut is optionally made for ease of machining. The tines in this size of section are six in number as indicated at 62 in FIG. 7.

External section 22 preferably is made of oxygen-free copper to provide for high conductivity. Internal sections 24, 26 and 28 preferably are made of beryllium copper to provide greater contact pressure. Cascaded pin 11 preferably is made of oxygen-free copper to provide for maximum conductivity.

Figure 9:
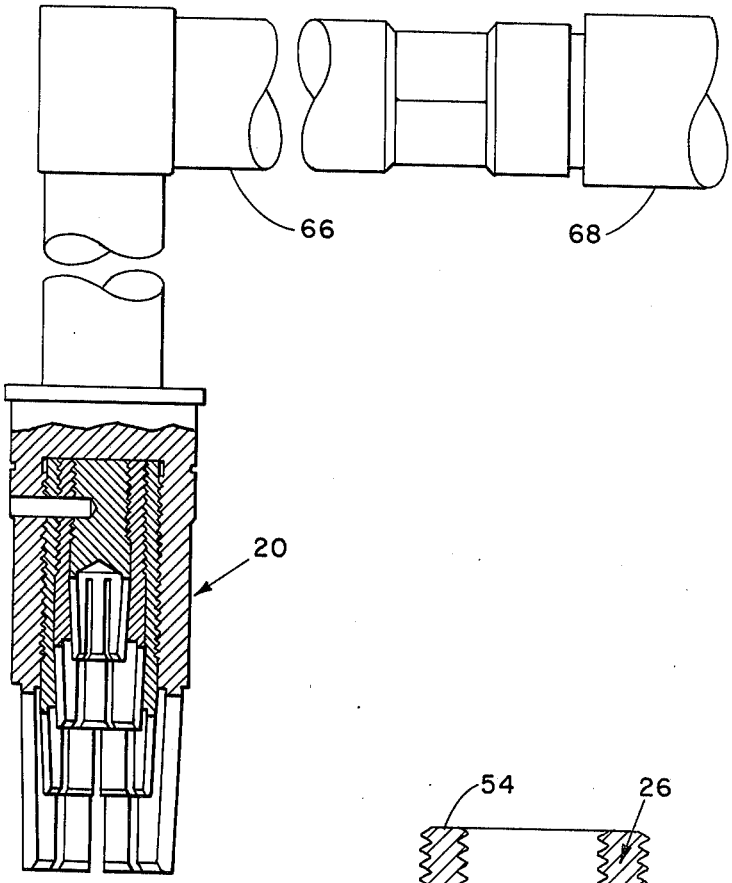
FIG. 9 is a front elevation partly in section of the receptacle sections assembled as a unit and connected to a conventional conductor and insulated cable.
Figure 8:
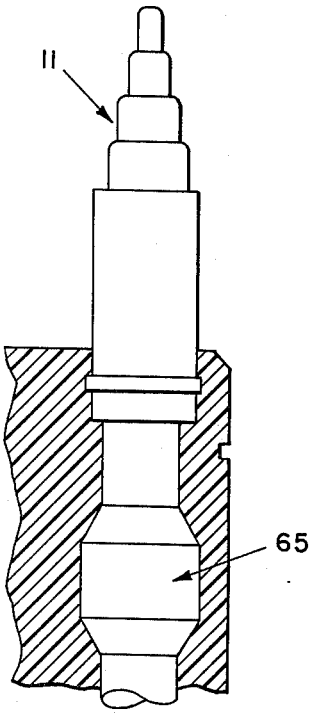
FIG. 8 is a front elevation of the pin portion of the contact of the present invention connected to a conventional conductor.

FIGS. 8 and 9 show cascaded pin 11 and receptacle 20 connected to conventional conductors by conventional means, not shown in detail. The pin and receptacle may be utilized in conventional electrical fitting envelopes as single conductors or in multiple combinations for a variety of applications. In FIG. 8, pin 11 is shown connected to a conductor 65 while in FIG. 9 receptacle 20 is shown in connected to a conductor 66 which in turn is crimped to an insulated cable 68. Conductors 65 and 66, when encapsulated in a pressure proof envelope, may provide for penetration through the pressure hull of a submarine to energize an external motor or other device from an internal power source or conversely to supply shore power from a source external to the submarine when in port. In this instance, the power conducted through three similar contact-receptacle combinations is used to energize a 440-v, 600 amp, 3 phase, 60 HZ propulsion motor.

There is thus provided a novel concept for conducting high current densities in or through areas where space restrictions severely limit the size of the connectors. The present combination of contact pin and receptacle represents also a considerable improvement over the standard slotted contacts in that the device is both compact and very efficient in achieving current transfer. The four-step cascaded pin and mating receptacle illustrated provide substantially $2\frac{1}{2}$ times the contact area of conventional designs without increasing the overall contact diameter. The current carrying cross-sectional tine area is nearly doubled in the cascade form of this contact. It will be appreciated that larger embodiments of this invention having a greater plurality of receptacle sections will provide still further improvements in contact area and cross-sectional tine area.

The cascaded contact concept provides for engagement of the pin and receptacle with zero insertion force until the final substantially $\frac{1}{2}$ inch of connector travel is reached. That is, all segments of the pin are brought into contact with mating sections of the receptacle at the same point of insertionand thereafter engagment is achieved wherein the mechanical advantage of the coupling mechanism accomplishes mating of the components.

The short contact engagement length of this invention provides a substantial improvement during engagement and disengagement as compared with conventional high amperage connectors. Considerable operator effort is normally required to mate and unmate conventional slotted connectors of equivalent size. The present contact-receptacle combination provides increased conductivity, lower operating temperatures and reduced contact resistance over conventional slotted connectors of the same general capacity. The threading of the individual sections within one another permits contact action on each segment of the mating step pin. The largest receptacle section of oxygen-free copper provides high electrical conductivity and satisfactory contact pressure while the interior beryllium copper sections operate at lower conductivity but are engaged with greater contact pressure. As noted above, the mechanical advantage of the coupling mechanism accomplishes mating and unmating of the components. Conventional high amperage slotted contact connectors often require considerable insertion effort by the operator prior to obtaining assistance from the coupling mechanism.

Obviously many modifications and variations of the present invention are possible in the light of the above teachings. For example, the metals used in the various components may be replaced with alternate metals of comparable conductivity, such as brass or bronze alloys, for the interior receptacle sections. If greater conductivity is desired, all receptacle sections may be oxygen-free copper with the smaller sections being spring loaded to provide sufficient contact pressure. In addition, the construction or joining together of the receptacle sections may be varied such as with each receptacle section machined with slight clearance between sections in lieu of the threaded portions, and subsequently assembled by soldering. The soldering process could be facilitated through the use of soft solder shims or preformed solder rings. Still another variation would be the use of a larger diameter external receptacle section and pin contact for applications of several thousand amperes. A larger plurality of internal receptacle section and mating cascade segments that illustrated in FIG. 1 would then be possible.

What is claimed is:

1. An electrical connector for providing high current density conduction comprising:

a contact including a pin connected to a first electrical lead and a receptacle connected to a second electrical lead, said pin having a plurality of cylindrical segments of decreasing size and said receptacle having a plurality of sections formed of tines for mating with each of said segments, said segments and respective mating sections making contact substantially simultaneously and only after said pin has been inserted a substantial distance into said receptacle, said tines initially canted inwardly, said tines forced open upon insertion of said pin so that at full insertion thereof said tines provide sectors of cylindrical surfaces intimately contacting respective surfaces of said pin, said pin being a single piece of material having said pin segment formed thereon, said sections each having a base portion and said tines extending generally axially therefrom, said base portions being assembled in close contact with one another at their peripheries and ends remote from said tines to utilize the greatest amount of surface contact for transfer of current at acceptable values of contact resistance and operating temperature.

2. The electrical connector of claim 1 wherein said contact pin has a base portion adapted for connection to said first lead and at least four segments each having successively lesser diameters than the preceding segment and said base portion; and said receptacle sections include an external section, first and second intermediate sections and an internal section secured together along their base peripheries, said external section being the base portion of said receptacle and adapted for connection with said second lead, said external section having a cavity for receiving said first intermediate section, said cavity having a transverse planar interior end surface and said intermediate and internal sections having planar end surfaces which abut against said transverse planar surface.

3. The electrical connector of claim 2 wherein said contact pin and said external receptacle section are made of oxygen-free copper to promote maximum conductivity and said intermediate and internal receptacle sections are made of beryllium copper to provide increased contact pressure.

4. The electrical connector of claim 3 wherein said pin segments come into contact with respective receptacle sections at the same point of insertion of said pin said receptacle and thereafter engagment between pin and receptacle is secured by the pressure of said tine surfaces against respective segment surfaces.

5. The electrical connector of claim 4 wherein the insertion force required to achieve mating of pin and receptacle is applied only through the final extent of relative movement therebetween, the annular end surfaces of said segments at full insertion abutting against the annular end surfaces of said tines, the tines of said intermediate and internal receptacle sections having axially extending pin contacting surfaces substantially greater in length than the axially extending contacting surfaces of respective pin segments.

6. The electrical connector of claim 5 wherein the contacting surfaces of said pin and receptacle are silver plated to reduce resistance during insertion while maintaining high conductivity.

7. An electrical contact comprising:

a contact pin having a plurality of contacting surfaces of decreasing size; and a receptacle having a like plurality of sections disposed one within another each of which is provided with contacting surfaces which mate with respective pin surfaces during the full extent of insertion of said pin into receptacle as defined by the axial length of the shortest of said pin contacting surfaces, said receptacle sections joined together remote from their contacting surfaces to form a unitary member.

8. The contact of claim 7 wherein said pin is circular in cross section and said receptacle sections are divided into arcuate contact fingers, said contact fingers on all but the exterior of said receptacle sections canted inwardly in the inoperative condition and spread outwardly by said pin when inserted into said receptacle.

9. The contact of claim 8 wherein said pin has a cylindrical base and cylindrical segments of decreasing diameter extending therefrom, said pin contacting surfaces being the peripheral surfaces of said segments, said peripheral surfaces making contact with said arcuate contact fingers substantially instantaneously after said pin has been inserted a substantial distance into said receptacle.

10. The contact of claim 9 wherein said pin segments are four in number and made integral with said pin and said receptacle sections include an external section having a partially threaded cavity, hollow first and second intermediate sections partially threaded internally and externally, and an internal section having a cavity for receiving the end segment of said pin and partially threaded externally, said external section cavity having a transverse planar interior end surface and said intermediate and internal sections having planar end surfaces which abut against said transverse planar surface, said internal section cavity and the contacting surfaces of said external and intermediate sections extending substantially longer axially than the axial length of respective pin segments.

11. The contact of claim 10 wherein the fingers on said outer sections are greater in number than the fingers on the inner sections and said pin and said external receptacle section are made of oxygen-free copper and said intermediate and said internal receptacle sections are made of beryllium copper to provide increases contact pressure.

12. The contact of claim 11 wherein the annular end surfaces of said segments at full insertion of said pin in said receptacle abut against the annular end surfaces of said arcuate fingers, the adjacent edges of said segments and said finger ends chamfered to facilitate coupling of said pin and receptacle.

* * * * *